US006915593B2

(12) United States Patent
Grüble et al.

(10) Patent No.: US 6,915,593 B2
(45) Date of Patent: Jul. 12, 2005

(54) DRYING RACK FOR A LAUNDRY DRYER

(75) Inventors: Barbara Grüble, Neufahrn (DE); Olaf Hoffmann, München (DE); Harald Moschütz, Grossbeeren (DE); Hans-Werner Stahn, Berlin (DE); Günter Steffens, Seeburg (DE)

(73) Assignee: Ash Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/629,927

(22) Filed: Jul. 30, 2003

(65) Prior Publication Data

US 2004/0118012 A1 Jun. 24, 2004

Related U.S. Application Data

(63) Continuation of application No. PCT/EP02/00804, filed on Jan. 25, 2002.

(30) Foreign Application Priority Data

Jan. 30, 2001 (DE) ..... 101 03 986

(51) Int. Cl.[7] ..... F26B 11/02
(52) U.S. Cl. ..... 34/600; 34/602; 34/595
(58) Field of Search ..... 34/237, 238, 600, 34/595, 602, 603

(56) References Cited

U.S. PATENT DOCUMENTS 3,316,659 A * 5/1967 Lauck ..... 34/600
3,344,532 A 10/1967 Bigler
3,724,095 A * 4/1973 Laue et al. ..... 34/139
4,091,548 A * 5/1978 Daily ..... 34/600
4,617,743 A * 10/1986 Barnard ..... 34/109
5,276,979 A 1/1994 Gordon, Sr.
6,026,592 A * 2/2000 Herr ..... 34/446
6,374,644 B1 4/2002 Rhode et al.

FOREIGN PATENT DOCUMENTS

| | | | |
|---|---|---|---|
| DE | 27 06 595 | A1 | 11/1977 |
| DE | 85 05 995 | U1 | 5/1985 |
| DE | 40 34 660 | A1 | 5/1992 |
| FR | 2 722 517 | A1 | 1/1996 |
| GB | 1 491 852 | | 11/1977 |
| JP | 4307096 | * | 10/1992 |
| JP | 09220399 | A | 8/1997 |

* cited by examiner

*Primary Examiner*—Denise L. Esquivel
*Assistant Examiner*—Kathryn S. O'Malley
(74) *Attorney, Agent, or Firm*—John T. Winburn; Russell W. Warnock; Craig J. Loest

(57) ABSTRACT

A drying rack can be fixed in the drum of a tumble dryer to dispose items to be dried in a static manner. The items can be, for example, woolens or shoes that should not be rotated with the moving drum during the drying process. To prevent the items to be dried from coming into contact with the rotating drum, the drying rack includes an external casing, which seals the rack off from the periphery of the drum. An internal rack, in particular, including several levels, can be located inside the external casing. The items to be dried can be distributed on the levels.

17 Claims, 2 Drawing Sheets

DRYING RACK FOR A LAUNDRY DRYER

CROSS-REFERENCE TO RELATED APPLICATION

This application is a continuation of copending International Application No. PCT/EP02/00804, filed Jan. 25, 2002, which designated the United States and was not published in English.

BACKGROUND OF THE INVENTION

Field of the Invention

The invention relates to a drying rack on which items that are to be dried are disposed in a stationary manner within a rotatable drum of a laundry dryer with a filling opening, which opens out into the drum, and a door for closing the filling opening and a laundry dryer with such a drying rack.

It may be necessary for items for drying to be disposed in a stationary manner if they are not permitted to move during the drying operation. This may be the case, for example, with knitwear and woolens, which would shrink if they moved during drying. The same may apply to shoes or other items for drying that could be damaged by the movement in the drum.

Such a drying rack or such a dryer is known, for example, from German Published, Non-Prosecuted Patent Application DE 40 34 660 A1. This document describes a drying rack that is in the form of a laundry basket and is fastened, at the rear, on the mounting of the drum rear wall, and, at the front, on the dryer door. The laundry basket is in the form of a shell that is open at the top and is produced from a wire grille. Comparable drying racks are known from German Published, Non-Prosecuted Patent Application DE 27 06 595, German Utility Model DE 85 05 995 U1, U.S. Pat. No. 3,344,532 to Bigler, U.S. Pat. No. 3,316,659 to Lauck, and U.S. Pat. No. 4,591,548. All of the above-mentioned documents, likewise, describe drying racks in the form of a shell that is open at the top. Drying racks so configured have, in particular, the disadvantage that the items for drying that are disposed therein project beyond the edge of the shell-like drying rack and may come into contact with the rotating drum. It is possible here for at least part of the item for drying to be moved and, as a result, to be damaged, which is precisely what is to be avoided by the stationary configuration. Moreover, it is also possible here for the drying rack to be carried along and to be damaged itself or to damage other parts of the dryer.

SUMMARY OF THE INVENTION

It is accordingly an object of the invention to provide a drying rack for a laundry dryer that overcomes the hereinafore-mentioned disadvantages of the heretofore-known devices of this general type and that reliably avoids damage to the items for drying during the drying operation.

With the foregoing and other objects in view, in a laundry dryer having a rotatable drum with a filling opening and a door for closing the filling opening, there is provided, in accordance with the invention, a drying rack including an air-permeable self-supporting outer enclosure on which items to be dried are disposed in a stationary manner within the drum, the outer enclosure being in the form of a closed grille in a circumferential direction of the drum, and fastening devices for removably fastening the outer enclosure to the laundry dryer.

In accordance with another feature of the invention, the outer enclosure has an end side with an access opening closed by the door when the outer enclosure is inserted into the drum.

In accordance with a further feature of the invention, the outer enclosure has a rear side and a grille termination on the rear side.

In accordance with an added feature of the invention, the outer enclosure is a wire grille.

The closed grille form of the drying rack prevents parts of the items for drying coming into contact with the drum, and also ensures that the quantity of items for drying and the extent to which the items are spread out are limited. The closed configuration, in addition, gives an operator a clear idea of the admissible quantity of items for drying.

This reliably avoids the situation where an excessively large quantity of items for drying is loaded onto the drying rack and parts of the items for drying can fall off the drying rack and get in between the drying rack and drum, and/or where parts of the items for drying come into contact with the moving drum and are damaged on account of the constant movement during the drying operation.

The drying rack may include a grille structure that has a smaller mesh width in the bottom region than in the top region or in which a bottom grille part is spanned by bars. It is, thus, possible to avoid the situation where small items for drying fall through and, nevertheless, to increase the safety.

The outer enclosure is, advantageously, closed on all sides, with the exception of an access opening, which may be disposed behind the filling opening of the laundry dryer and closed, in particular, by the door of the latter. The drying rack may, for example, be in the form of a cylinder that is open on an end side and can be inserted horizontally into the laundry dryer.

In accordance with an additional feature of the invention, an inner rack is disposed in the outer enclosure.

By an inner rack, which may be disposed within the outer enclosure, it is possible to increase to a considerable extent the surface area over which the items for drying can be spread out. It is, thus, possible to achieve the situation where the drying air can better reach the items for drying. The inner rack may have, in particular, planes that are disposed one above the other, the edge regions, in particular, being open for the most part. It is, thus, possible for relatively large items for drying to be distributed over a number of planes, by one part being disposed on one plane and the part that projects beyond the plane edge being folded over around the edge and being disposed on an adjacent plane. For example, it is, advantageously, possible for a pullover to be disposed on such an inner rack with three planes, in which case the chest region is disposed in the top plane, the sleeves can be folded over at the sides and disposed on the central plane, located beneath the top plane, and the trunk region of the pullover, which follows the chest region, is positioned in the same way in the lowermost plane. If the inner rack is configured as the separate part, it is possible for the operator, first of all, to fasten the outer enclosure in the laundry dryer, then, to configure the items for drying on the inner rack, and, finally, to position the inner rack in the outer enclosure.

In accordance with yet another feature of the invention, the inner rack has at least two air-permeable planes disposed substantially parallel to one another.

The drying rack may always be configured such that the inner rack is kept at a distance from the base of the outer enclosure so, in addition to the planes of the inner rack, the base of the outer enclosure can be utilized for depositing items for drying.

Three fastening devices are, advantageously, provided for fastening the drying rack on the laundry dryer to prevent mechanical redundancy, it being possible for the three fastening devices to be provided, for example, at the bottom center and to the left and right of the filling opening of the laundry dryer.

In accordance with yet a further feature of the invention, there are provided connecting elements. The planes have corners, are connected to one another at the corners, and are kept at a distance apart from one another by the connecting elements.

In accordance with yet an added feature of the invention, the planes are fine-meshed and flexible plastic grilles each with an enclosing plastic frame.

In accordance with again a further feature of the invention, the outer enclosure has at least two parts connected to one another in an articulated manner.

In accordance with again another feature of the invention, the two parts of the outer enclosure fully enclose the inner rack in an operational state.

In accordance with yet an additional feature of the invention, the inner rack is connected in an articulated manner to one of the two parts of the outer enclosure.

An articulated connection between the inner rack and outer enclosure, in addition, reduces the risk of the inner rack being lost. Even in the case of an articulated connection between the inner rack and outer enclosure, it is possible for the inner rack to be configured with a number of planes.

In accordance with again an added feature of the invention, the outer enclosure has at least two parts pivotably connected to one another.

In accordance with again an additional feature of the invention, the at least two parts enclose the inner rack in an operational state and the inner rack is pivotably connected to one of the at least two parts of the outer enclosure.

With the objects of the invention in view, there is also provided a drying rack, including an air-permeable self-supporting outer enclosure on which items to be dried are disposed in a stationary manner within a laundry drum of a laundry dryer, the outer enclosure being in the form of a closed grille in a circumferential direction of the drum and fastening devices for removably fastening the outer enclosure to the laundry dryer.

With the objects of the invention in view, there is also provided a drying rack, including an air-permeable self-supporting outer enclosure on which items to be dried are disposed in a stationary manner within a laundry drum of a laundry dryer, the outer enclosure being in the form of a closed grille in a circumferential direction of the drum, an inner rack disposed in the outer enclosure and having at least two air-permeable planes disposed substantially parallel to one another, and fastening devices for removably fastening the outer enclosure to the laundry dryer.

With the objects of the invention in view, there is also provided a laundry dryer, including a rotatable drum having a front bearing plate with a filling opening, a door for closing the filling opening, dryer fastening devices, and a drying rack having an air-permeable self-supporting outer enclosure on which items to be dried are disposed in a stationary manner within the drum, the outer enclosure being in the form of a closed grille in a circumferential direction of the drum and rack fastening devices corresponding with the dryer fastening devices and removably fastening the outer enclosure to the dryer fastening devices.

Other features that are considered as characteristic for the invention are set forth in the appended claims.

Although the invention is illustrated and described herein as embodied in a drying rack for a laundry dryer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
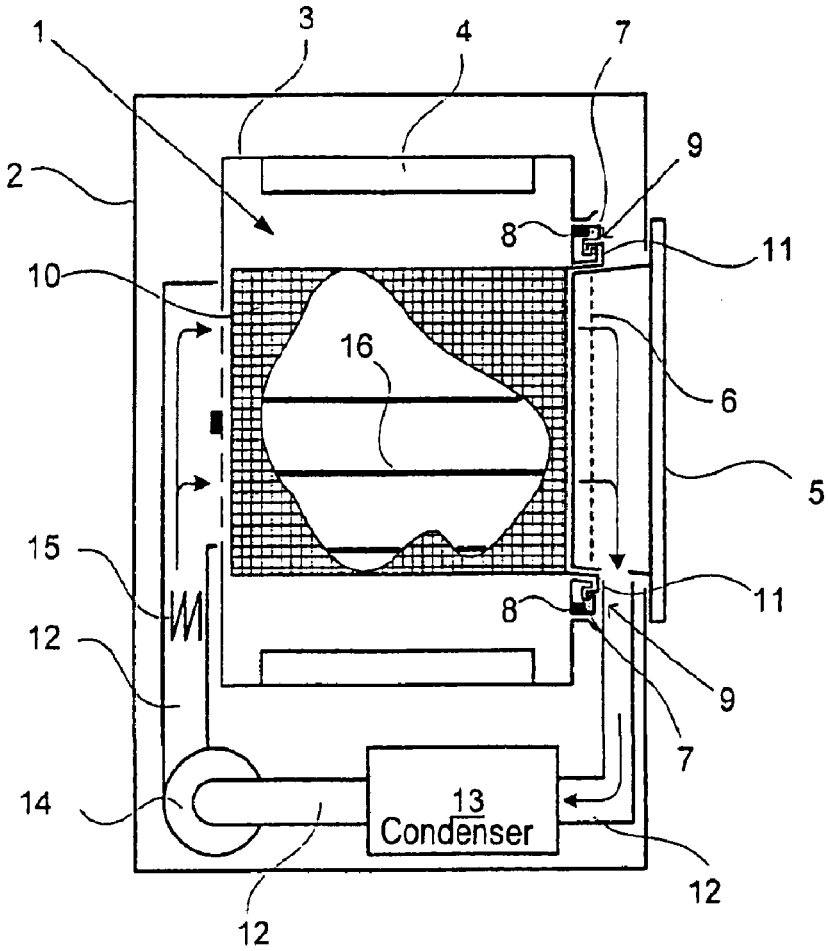
FIG. 1 is a cross-sectional view through a laundry dryer with a first embodiment of a drying rack according to the invention inserted therein.

Referring now to the figures of the drawings in detail and first, particularly to FIG. 1 thereof, there is shown a laundry dryer 2 having a drum 3 that can be rotated about a horizontal axis and within which are fastened carry-along elements 4 for the laundry, these moving the laundry as the drum rotates. Also provided are a fan 14, a heater 15, and a condenser 13, to produce an air circuit, which is closed by the air channel 12, through the drum 3. In such a case, air heated by the heater 15 is directed from the rear, through the perforated base of the drum 3, into the drum 3, comes into contact there with the laundry that is to be dried and flows through the filling opening of the drum 3 to a lint filter 6 within a dryer door 5, which closes the filling opening. The air stream is then deflected downwards in the dryer door 5 and directed by the air channel 12 to the condenser 13, in which moisture in the laundry that is absorbed by the air by cooling is condensed and discharged. Following the condenser 13, air is directed to the heater 15 again by the fan 14.

The drum 3 is mounted, at the rear, on the base by a rotary bearing and, at the front, by a bearing plate 7, the drum 3 resting, by way of a flange, on a sliding strip 8 on the bearing plate 7 and, thus, being retained at the front end.

Furthermore, a drying rack 1 is disposed within the drum 3. This drying rack 1 includes an outer enclosure 10 and an inner rack 16 disposed within the outer enclosure 10. The outer enclosure 10 includes a cylindrical wire basket that is closed at a base. At its front open end, the outer enclosure 10 of the drying rack 1 has fastening lugs 11 that can interact with corresponding fastening mount 9, which are formed within the bearing plate 7. By virtue of fastening the drying rack 1 exclusively on the bearing plate 7, it is possible for the drying rack 1 to be disposed, with particularly low outlay, in a stationary manner within the rotatable drum 3.

Figure 4:
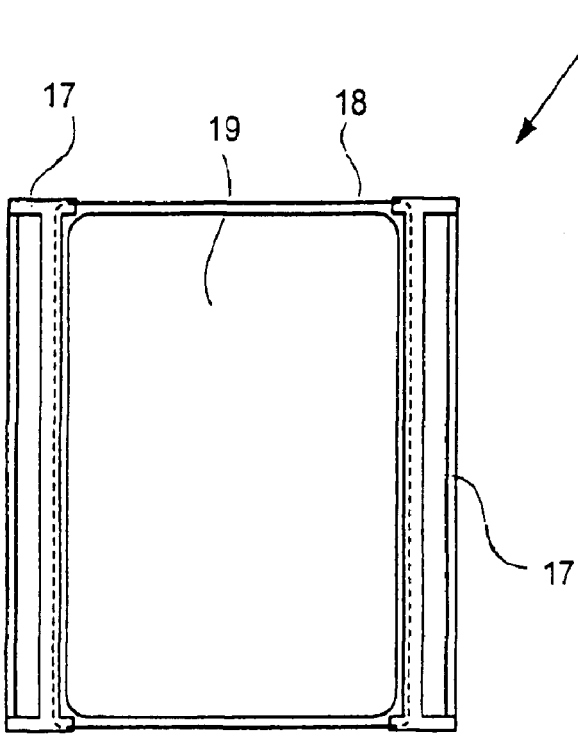
FIG. 4 is a plan elevational view of a drying rack of the first embodiment according to the invention.
Figure 5:
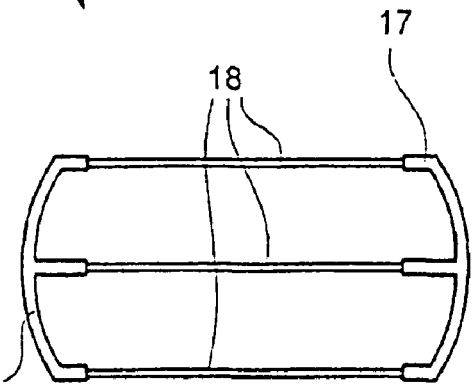
FIG. 5 is a front elevational view of the drying rack of FIG. 4.
Figure 6:
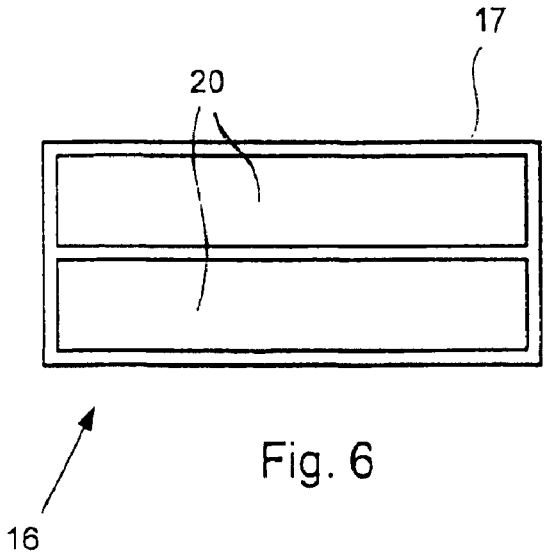
FIG. 6 is a side elevation view of the drying rack of FIG. 4.

A first embodiment of the inner rack 16, which is only illustrated in part in FIG. 1, is, additionally, illustrated in FIGS. 4 to 6. The plan view of FIG. 4 shows two edge parts 17 that serve for connecting the planes disposed one above the other. The individual planes are formed by the plastic frame 18, in which a fine, air-permeable plastic netting 19 is braced. This may be achieved by positioning the plastic netting 19, during production of the frame 18, in the mold of the latter and being injection molded in the frame 18.

The front view, which is illustrated in FIG. 5, shows the fastening of the plastic frames 18 in the side parts 17. For such a purpose, the E-shaped side parts 17 have mounts into which the plastic frames 18 can be plugged and, if appropriate, latched.

This configuration, advantageously, means that only two types of part are necessary: the side part 17, on one hand, and, on the other hand, the planes including the frame 18 and plastic netting 19.

FIG. 6 illustrates the inner rack 16 from the side, this illustrating, in particular, the lateral access openings 20 within the side parts 17, through which it is possible to reach between the planes from the side. As such, it is possible for an item to be dried that projects beyond a plane to be folded over around the edge both at the side and at the front and for the folded-over part to be disposed on an adjacent plane. For example, a pair of trousers can, thus, be positioned in an S-shaped manner in the inner rack. In the case of a pullover, it is possible, for example, for the chest region to be folded over onto the top plane, for the lower trunk region to be folded over in the front region and positioned on the bottom plane and for the sleeves to be positioned on the central plane from the side.

It is, nevertheless, possible to use the outer enclosure 10 without the inner rack 16 to dry, for example, shoes therein.

Figure 2:
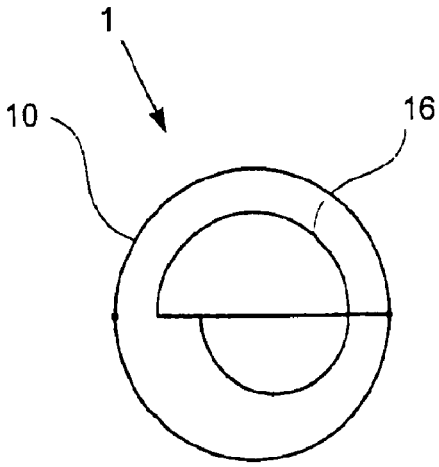
FIG. 2 is a front elevational view of a second embodiment of the drying rack according to the invention.
Figure 3:
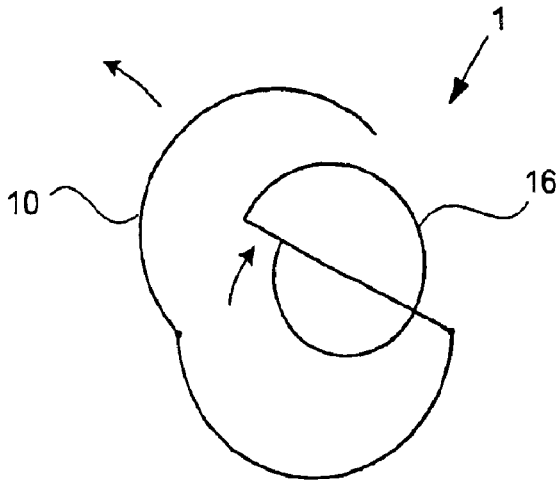
FIG. 3 is a front elevational view of the drying rack of FIG. 2 in an open state.

A second embodiment of the drying rack 1 is illustrated in FIGS. 2 and 3, in which the inner rack 16 is connected in an articulated manner to the outer enclosure 10, the outer enclosure 10 additionally including two swing-action parts. It is, thus, possible for the inner rack 16 to be fully enclosed by the outer enclosure 10. As a result, the safety can be further increased. The outer enclosure 10 is in the form of a barrel and is separated, along the axis, into two parts, which are connected to one another in an articulated manner along a lateral line. On the side that is located opposite the articulation between the two enclosure parts, the inner rack 16 is articulated on one of the enclosure parts. In this exemplary embodiment too, the inner rack 16 has three planes, the top and the bottom planes being curved. In addition, it is also possible for items for drying to be deposited on the outer enclosure 10 on the inside, beneath the inner rack 16.

It is generally possible, in the case of an outer enclosure 10 made of parts that are connected to one another in an articulated manner, to provide that the enclosure 10 can be introduced into the dryer, and/or fastened within the drum, only when the parts have been swung together. Furthermore, for safety purposes, it may also be provided that the opening angle of the swing-action parts is limited. As a result, they reliably close again of their own accord without force being applied from the outside. It is, thus, possible to reduce the risk of the outer enclosure 10 accidentally swinging open during the drying operation.

We claim:

1. In a laundry dryer having a rotatable drum with a filling opening and a door for closing the filling opening, a drying rack comprising:

an air-permeable self-supporting outer enclosure disposed in a stationary manner inside the drum for disposing items to be dried in a stationary manner within the drum, said outer enclosure being in the form of a closed cylindrical wire basket; and fastening devices for removably fastening said outer enclosure to the laundry dryer.

2. The drying rack according to claim 1, wherein said outer enclosure has an end side with an access opening closed by the door when said outer enclosure is inserted into the drum.

3. The drying rack according to claim 2, wherein said outer enclosure has a rear side and a grille termination on said rear side.

4. The drying rack according to claim 1, wherein said outer enclosure is a wire grille.

5. The drying rack according to claim 1, wherein said outer enclosure has a wire grille.

6. The drying rack according to claim 1, further comprising an inner rack disposed in said outer enclosure.

7. The drying rack according to claim 6, wherein said inner rack has at least two air-permeable planes disposed substantially parallel to one another.

8. The drying rack according to claim 7, further comprising connecting elements, said planes having corners, being connected to one another at said corners, and being kept at a distance apart from one another by said connecting elements.

9. The drying rack according to claim 7, wherein said planes are fine-meshed and flexible plastic grilles each with an enclosing plastic frame.

10. The drying rack according to claim 1, wherein said outer enclosure has at least two parts connected to one another in an articulated manner.

11. The drying rack according to claim 10, further comprising an inner rack disposed in said outer enclosure, said at least two parts fully enclosing said inner rack in an operational state.

12. The drying rack according to claim 11, wherein said inner rack is connected in an articulated manner to one of said at least two parts of said outer enclosure.

13. The drying rack according to claim 7, wherein said outer enclosure has at least two parts pivotably connected to one another.

14. The drying rack according to claim 13, wherein:

said at least two parts enclose said inner rack in an operational state; and said inner rack is pivotably connected to one of said at least two parts of said outer enclosure.

15. A drying rack, comprising:

an air-permeable self-supporting outer enclosure for disposing items to be dried in a stationary manner within a laundry drum of a laundry dryer, said outer enclosure being disposed in a stationary manner inside the drum and being in the form of a closed cylindrical wire basket; and fastening devices for removably fastening said outer enclosure to the laundry dryer.

16. A drying rack, comprising:

an air-permeable self-supporting outer enclosure on which items to be dried are disposed in a stationary manner within a laundry drum of a laundry dryer, said outer enclosure being in the form of a closed grille in a circumferential direction of the drum;

an inner rack disposed in said outer enclosure and having at least two air-permeable plane disposed substantially parallel to one another; and fastening devices for removably fastening said outer enclosure to the laundry dryer.

17. A laundry dryer, comprising:

a rotatable drum having a front bearing plate with a filling opening;

a door for closing said filling opening;

dryer fastening devices; and a drying rack having:

an air-permeable self-supporting outer enclosure for disposing items to be dried in a stationary manner within the drum, said outer enclosure being disposed in a stationary manner inside the drum and being in the form of a closed cylindrical wire basket; and rack fastening devices corresponding with said dryer fastening devices and removably fastening said outer enclosure to said dryer fastening devices.

* * * * *

UNITED STATES PATENT AND TRADEMARK OFFICE

CERTIFICATE OF CORRECTION

PATENT NO. : 6,915,593 B2
DATED : July 12, 2005
INVENTOR(S) : Gruble et al.

It is certified that error appears in the above-identified patent and that said Letters Patent is hereby corrected as shown below:

Title page,
Item [73], Assignee, should read
-- BSH Bosch and Siemens Hausgeräte GmbH, Munich (DE) --.

Signed and Sealed this

Twenty-eighth Day of March, 2006

JON W. DUDAS
*Director of the United States Patent and Trademark Office*